US010492592B2

(12) United States Patent
Arroyo

(10) Patent No.: US 10,492,592 B2
(45) Date of Patent: Dec. 3, 2019

(54) SLEEPING BACKPACK TROLLEY BAG

(71) Applicant: Lorelyn Cajucom Arroyo, Saint Petersburg, FL (US)

(72) Inventor: Lorelyn Cajucom Arroyo, Saint Petersburg, FL (US)

( * ) Notice: Subject to any disclaimer, the term of this patent is extended or adjusted under 35 U.S.C. 154(b) by 59 days.

(21) Appl. No.: 15/621,582

(22) Filed: Jun. 13, 2017

(65) Prior Publication Data

US 2018/0352941 A1 Dec. 13, 2018

(51) Int. Cl.

| | |
|---|---|
| ***A45F 4/06*** | (2006.01) |
| ***A45F 4/00*** | (2006.01) |
| ***A45C 5/06*** | (2006.01) |
| ***A45C 5/14*** | (2006.01) |
| ***A45C 9/00*** | (2006.01) |
| ***A45C 13/02*** | (2006.01) |
| ***A45C 15/00*** | (2006.01) |
| ***A45C 15/06*** | (2006.01) |
| ***A45F 3/04*** | (2006.01) |

(52) U.S. Cl.

CPC ..... *A45F 4/06* (2013.01); *A45C 5/06* (2013.01); *A45C 5/14* (2013.01); *A45C 9/00* (2013.01); *A45C 13/021* (2013.01); *A45C 15/00* (2013.01); *A45C 15/06* (2013.01); *A45F 3/04* (2013.01); *A45F 4/00* (2013.01); *A45C 2009/007* (2013.01); *A45F 2200/0516* (2013.01)

(58) Field of Classification Search

CPC ..... A45F 4/06; A45F 3/14; A45F 4/00; A45F 2200/00; A45F 2200/0516; A45C 13/00; A47G 9/00

USPC ..... 224/156

See application file for complete search history.

(56) References Cited

U.S. PATENT DOCUMENTS

| | | | | |
|---|---|---|---|---|
| 5,649,658 | A * | 7/1997 | Hoffman | A45F 3/04 190/2 |
| 7,058,997 | B1 * | 6/2006 | Klinger | A45F 4/08 190/18 A |
| 8,490,230 | B2 * | 7/2013 | Rovin | A47D 5/006 190/2 |
| 9,144,290 | B1 * | 9/2015 | Hall | A45F 4/00 |
| 9,357,824 | B2 * | 6/2016 | McDonald | A47C 27/081 |
| 2007/0262103 | A1 * | 11/2007 | Blakley | A45B 11/02 224/190 |
| 2009/0316426 | A1 * | 12/2009 | Gilligan | A45C 15/06 362/551 |
| 2011/0056788 | A1 * | 3/2011 | Jackson | A45B 23/00 190/2 |

(Continued)

*Primary Examiner* — Corey N Skurdal

(74) *Attorney, Agent, or Firm* — Michael L. Greenberg, Esq.; Greenberg & Lieberman, LLC

(57) ABSTRACT

A backpack apparatus equipped with an extendable inflatable sleep surface is shown. The apparatus is configured to appear similar to that of a conventional backpack, having dual straps for shoulder carry, as well as wheels and an extendable handle. An inflatable sleeping surface is concealed within the apparatus, and is configured to extend out from the apparatus when desired. Horizontal straps ensure that the sleeping surface remains retracted during travel, or the surface is housed within a compartment of the apparatus. A retractable awning is disposed at a top of the apparatus, and is configured to extend in order to provide shade during rest. The awning is equipped with a night light. The apparatus is preferably equipped with an internal battery, which may be used to recharge portable electronics via a USB output.

5 Claims, 4 Drawing Sheets

(56) References Cited

U.S. PATENT DOCUMENTS

| | | | | |
|---|---|---|---|---|
| 2013/0036556 | A1* | 2/2013 | Ashby | A47C 27/082 5/713 |
| 2013/0228600 | A1* | 9/2013 | Teixeira | A45F 4/08 224/156 |
| 2014/0146525 | A1* | 5/2014 | Lueptow | A45C 15/06 362/103 |
| 2014/0326558 | A1* | 11/2014 | Marti | A45C 9/00 190/2 |
| 2016/0084492 | A1* | 3/2016 | Voskanian | A45C 15/06 362/555 |

* cited by examiner 70
80
215
220
225
60
50

70
100
90
20
100
110
90
180
210
250
95
50
95
10
130
200

70
20
10
60
95

SLEEPING BACKPACK TROLLEY BAG

FIELD OF THE PRESENT INVENTION

The present invention relates to an apparatus for use while travelling, and more specifically relates to a backpack with an enclosed sleeping surface that is configured to open to facilitate the form of a temporary soft seat or mattress, and is equipped with a clothing compartment.

BACKGROUND OF THE PRESENT INVENTION

It is known in the art that backpacks are a conventional form of luggage configured to be worn on the back and shoulders of an individual. Commonly, backpacks are used for brief trips, and often carry overnight clothing, school supplies, or other necessities. When backpacks are used for overnight stays, many users must carry a separate sleeping bag and pillow to make their stay comfortable. This adds bulk to the individual's baggage, and may even require an additional bag or two to facilitate transport of the sleeping bag and pillow. This can be especially cumbersome in many travel instances. If the individual wishes to sleep in comfort, a portable air mattress is often brought along in lieu of, or in addition to the sleeping bag. Unfortunately, many air mattresses require an external pump to inflate the mattress, which adds even more bulk to the individual's travel bags.

Even for quick trips to the beach, users often wish to lie down, and are known to rest on their backpack as a pillow for comfort. Unfortunately, in such use cases, nothing is usually present to protect the pants and shirt of the user from sand or dirt.

If there were a way in which a sleeping surface could be integrated into the backpack itself, traveling individuals would have less items to carry, and would not likely require multiple bags.

Thus, there is a need for a new type of backpack which is equipped with an integrated sleeping surface. Such a backpack is preferably similarly shaped to a conventional backpack, with standard compartment, however the sleeping surface may be extended from the front of the backpack, and preferably includes an extendable awning.

SUMMARY OF THE PRESENT INVENTION

The present invention is a specialized backpack apparatus equipped with multiple conventional compartments, as well as an extendable and preferably inflatable sleeping surface. As such, the present invention is configured to function both as a conventional backpack, as well as a connected air mattress. The preferred embodiment of the present invention is equipped with an air pump, powered by an internal rechargeable battery. The battery is preferably equipped with at least one powered USB output, which enables the user to charge a mobile device.

The apparatus of the present invention is preferably equipped with at least one handle, as well as shoulder straps. The sleeping surface is preferably configured to fold when deflated, and rest against the front of the apparatus when not in use. The sleep surface is preferably equipped with a retractable awning, configured to block sunlight and protect the eyes of the user. Additionally, the present invention is preferably equipped with wheels disposed on the bottom of the apparatus, which may optionally be used to move the apparatus. Opposite the wheels, dual supports are preferably disposed, which maintain the apparatus upright when at rest.

A trolley handle is preferably disposed on the top of the apparatus, which is configured to elongate so that the user may pull the apparatus easily on the wheels. The trolley handle is preferably equipped with a hinge which enables it to function as a kickstand to support the present invention when in use as a sleeping surface. Two additional stands may be disposed on the front of apparatus to further support the present invention when flipped forward, which prevent the present invention from tipping.

The air mattress is preferably configured to be inflated via an onboard air pump, which is powered via a rechargeable power source. Additionally, a manual pump option is preferably present to facilitate inflation without power. An air insert is preferably disposed on an exterior end of the air mattress for connection to a manual air pump. The air insert may be opened to quickly deflate the air mattress. The air mattress portion of the present invention is preferably easy to remove and replace in the event of damage via puncture.

BRIEF DESCRIPTION OF THE DRAWINGS

The present invention will be better understood with reference to the appended drawing sheets, wherein.

DETAILED DESCRIPTION OF THE PREFERRED EMBODIMENT

Figures 1, 2, 3:
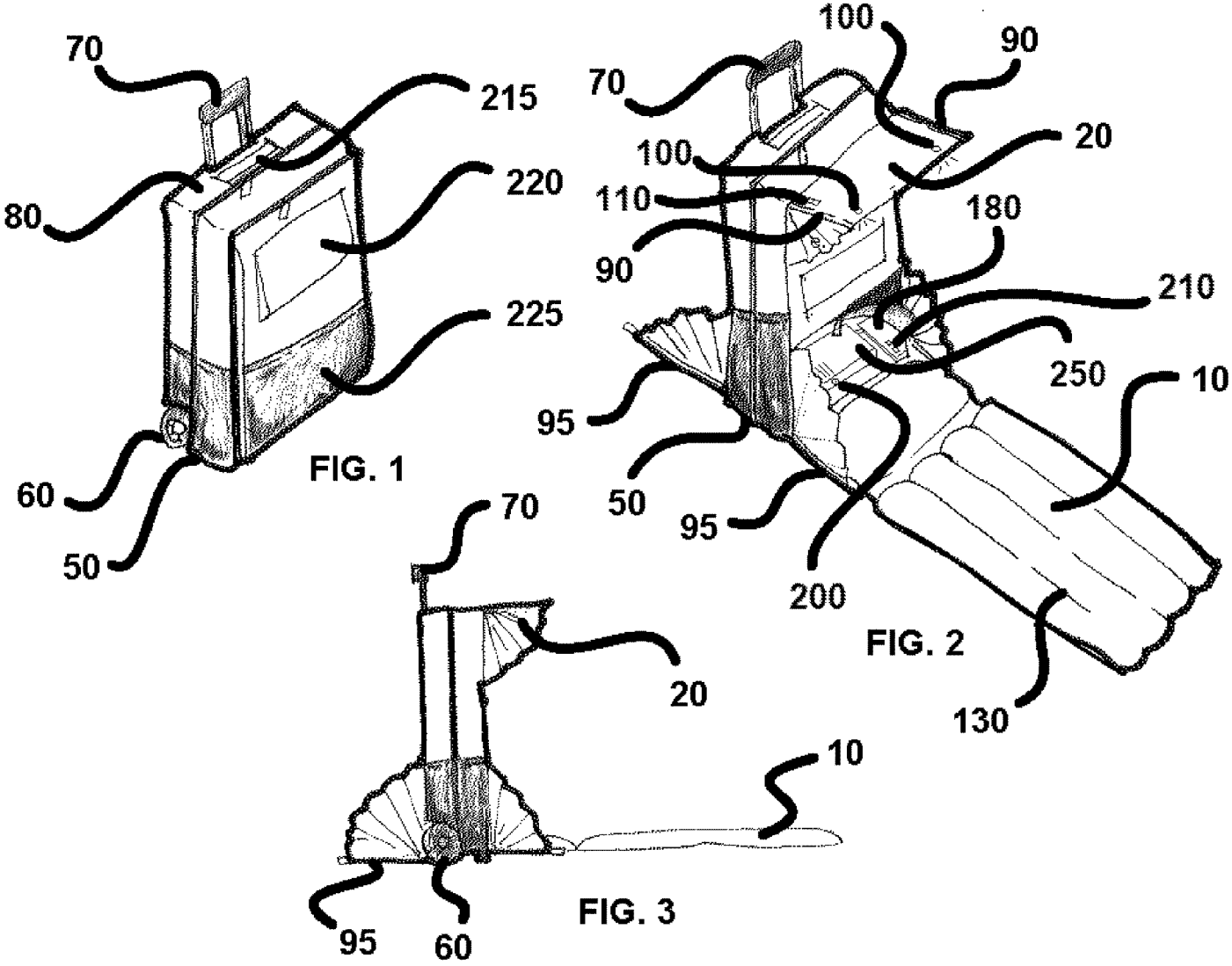
FIG. 1 exhibits a diagram depicting a first embodiment of the present invention as seen from the front.
FIG. 2 displays a view of the first embodiment of the present invention, showing the sleeping surface extended and inflated.
FIG. 3 depicts a view of the right side of the first embodiment of the present invention.
Figure 5:
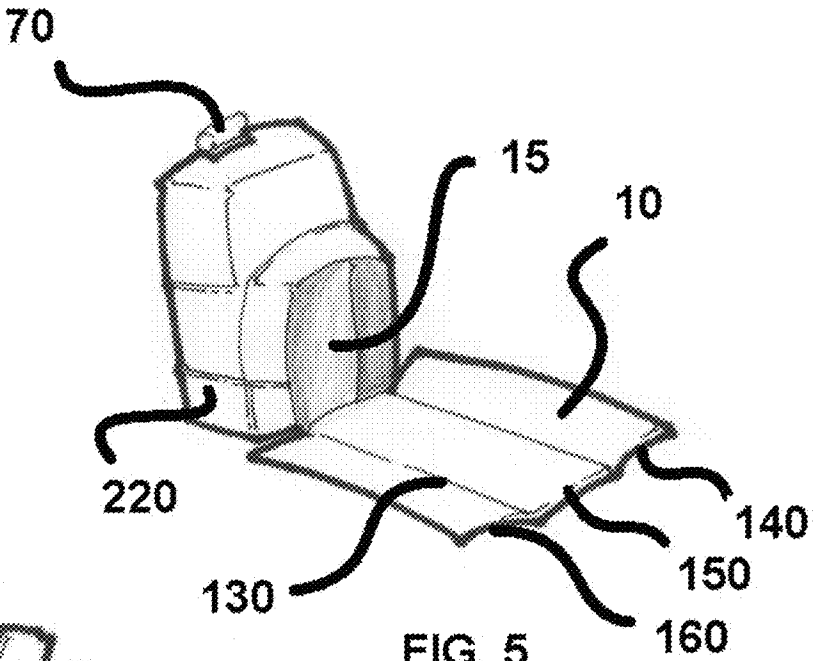
FIG. 5 shows a perspective view of the second embodiment of the present invention, shown with the sleeping surface extended.
Figure 6:
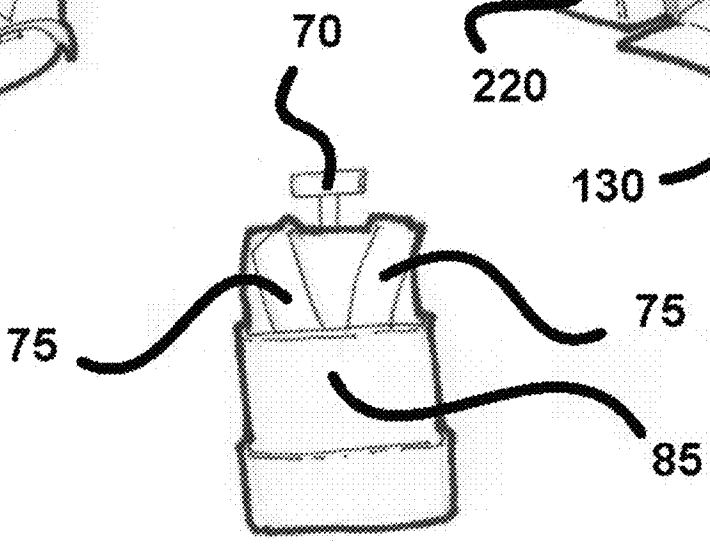
FIG. 6 depicts a view of the rear of the second embodiment of the present invention.
Figure 4:
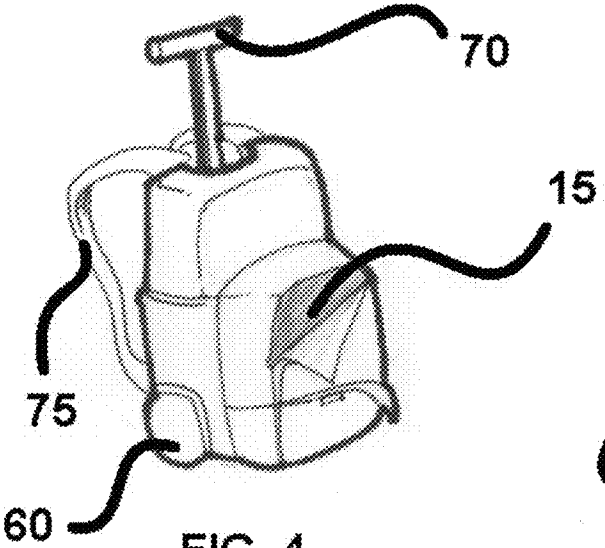
FIG. 4 shows a perspective view of a second embodiment of the present invention.

The present invention is an enhanced backpack apparatus equipped with a retractable sleeping surface (10), as well as a retractable awning (20). The apparatus has backpack straps (30) positioned on a rear exterior (40) of the apparatus. The retractable sleeping surface (10) is positioned on a front exterior (45) of the apparatus, and is configured to be released and extended when needed. A base (50) of the present invention is preferably equipped with wheels (60), which facilitate ground transport of the apparatus of the present invention. A trolley handle (70), disposed at a top (80) of the present invention, enables the user to pull the apparatus, allowing it to roll on the wheels (60) for transport. The trolley handle (70) preferably extends from the top (80), elongating the trolley handle (70) for comfortable use. A standard handle (215) is also preferably disposed on the top (80) of the apparatus. A cover flap (225) is preferably disposed on the exterior of the apparatus, which is configured to be flipped up to reveal the compartments (220) and sleeping surface (10) of the present invention.

The retractable awning (20) of the present invention is preferably equipped with support struts (90), which extend from the top (80) of the apparatus. The retractable awning (20) preferably employs a canvas or similar material, which is supported by the support struts (90). At least one LED light (100) is preferably disposed within the support struts (90), enabling night use of the present invention. The at least one LED light (100) is preferably configured to cast illumination to the sleeping surface (10) for use as a reading light. A power switch (110) is preferably disposed adjacent to the at least one LED light (100) to facilitate activation and deactivation of the at least one LED light (100) by the user when desired. A rechargeable power source (180) is preferably disposed in communication with the at least one LED light (100) and the power switch (110). It is envisioned that the rechargeable power source (180) may be recharged by the user via an input (200). Additionally, some embodiments of the present invention are preferably equipped with at least one USB output (210) to facilitate charging of mobile devices of the user via a USB cable.

The sleeping surface (10) of the present invention preferably consists of three panels—a first panel (140), a second panel (150), and a third panel (160), which are configured to fold at creases (130) when the sleeping surface (10) is not in use. At least one hidden compartment (170) is preferably disposed within the third panel (160) to be used as storage. In some embodiments of the present invention, the first panel (140), second panel (150) and/or third panel (160) may be inflated for comfort. In such embodiments, an air pump (250) is preferably disposed in communication with the panels to facilitate inflation. The air pump (250) may be manually operated, or may be equipped with an electric motor, powered by the rechargeable power source (180), to facilitate rapid and easy inflation. The sleeping surface (10) is preferably equipped with an air insert (235) to facilitate manual inflation, or inflation via an external air pump. The sleeping surface (10) is preferably housed within a mattress compartment, referenced as a sleeping surface storage compartment (15), when not in use. Some embodiments of the present invention may be equipped with an air pump pocket (245) to house the air pump (250) when not in use.

In some embodiments of the present invention, the sleeping surface (10) is not configured to detach, and instead is supported by at least one stand (230), preferably disposed on either side of the sleeping surface (10). Additionally, the trolley handle (70) of the present invention is preferably equipped with a hinge (240), which facilitates the use of the trolley handle (70) as a reinforcing stand of the apparatus, as shown in FIG. 2. In other areas of the apparatus, several compartments (220) are disposed for storage.

Figure 8:
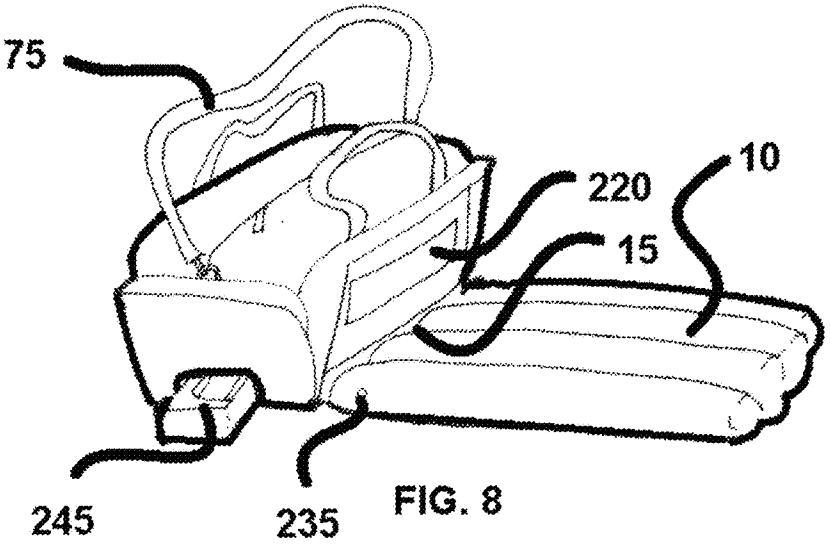
FIG. 8 shows a perspective view of the third embodiment of the present invention, showing the sleeping surface extended.
Figure 7:
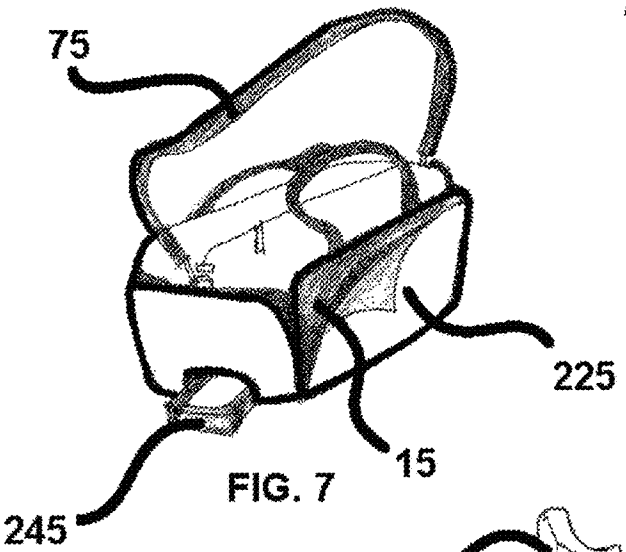
FIG. 7 shows a perspective view of a third embodiment of the present invention.
Figure 9:
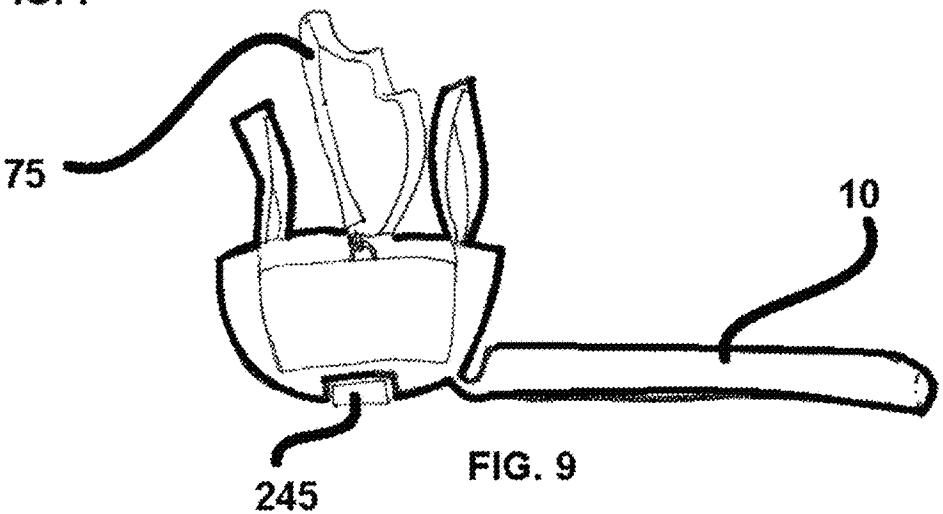
FIG. 9 details a view of the third embodiment of the present invention as seen from the right side.
Figure 10:
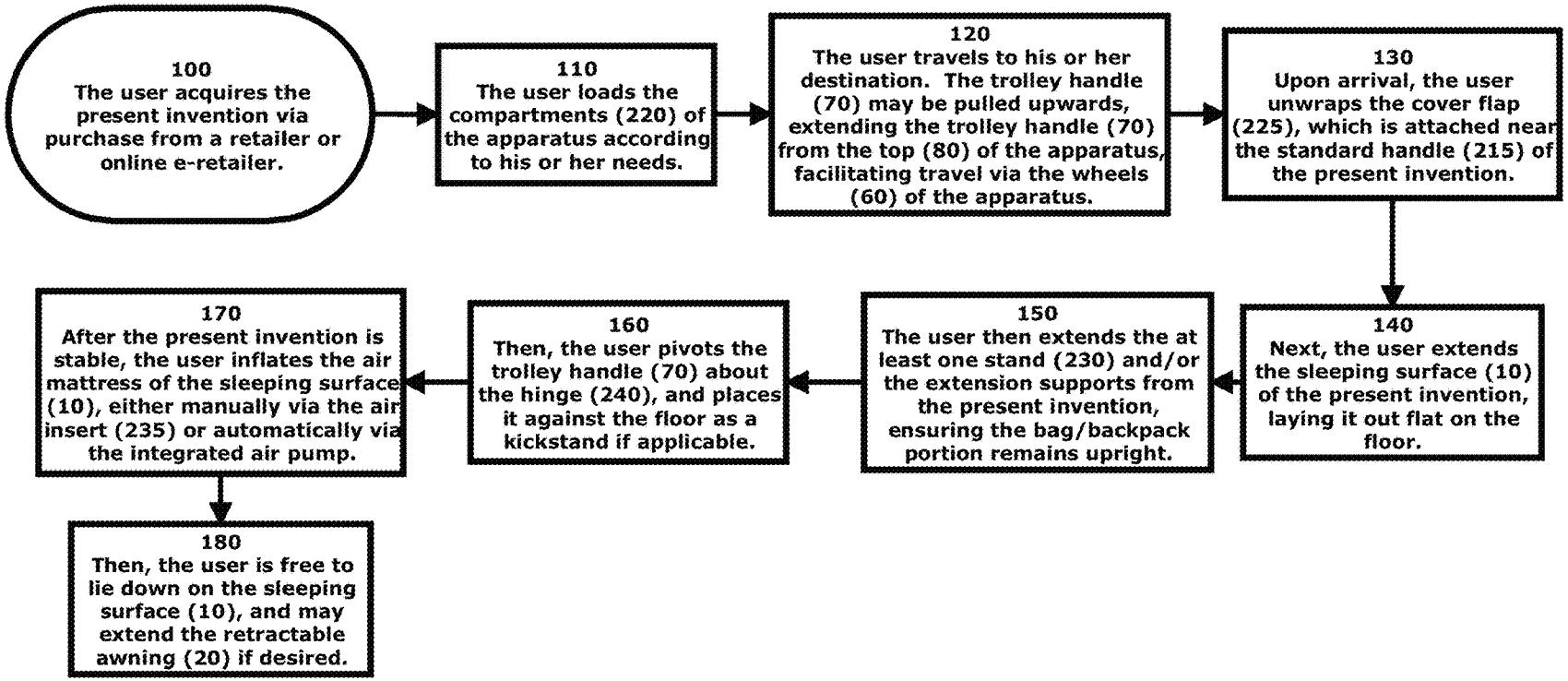
FIG. 10 displays a flowchart depicting the process of use of the present invention from the viewpoint of a user.

Extension supports (95) are preferably disposed on either side of the sleeping surface (10), and are preferably affixed to the base (50) of the present invention as shown in FIGS. 1-3. Dual extension supports (95) also preferably extend from the rear exterior (40) of the present invention, as shown in FIG. 2. It should be understood that some embodiments of the present invention are equipped with shoulder straps (75) disposed on the rear (40). The shoulder straps (75) may be placed within a strap compartment (85) for storage when not in use. The third embodiment of the present invention, as shown in FIGS. 7-9 employ a different form of shoulder straps (75), configured for use by one shoulder at a time.

The process of installation and use of the present invention, as depicted in FIG. 3, is preferably as follows:

1. The user acquires the present invention via purchase from a retailer or online e-retailer. (100) The present invention is preferably shipped to the location specified by the user if ordered online.

2. The user loads the compartments (220) of the apparatus according to his or her needs. (110)

3. The user travels to his or her destination. The trolley handle (70) may be pulled upwards, extending the trolley handle (70) from the top (80) of the apparatus, facilitating travel via the wheels (60) of the apparatus. (120)

4. Upon arrival, the user unwraps the cover flap (225), which is attached near the standard handle (215) of the present invention. (130)

5. Next, the user extends the sleeping surface (10) of the present invention, laying it out flat on the floor. (140)

6. The user then extends the at least one stand (230) from the present invention, ensuring the bag portion remains upright. (150)

7. Then, the user pivots the trolley handle (70) about the hinge (240), and places it against the floor as a kickstand. (160)

8. After the present invention is stable, the user inflates the air mattress of the sleeping surface (10), either manually via the air insert (235) or automatically via the integrated air pump. (170)

9. Then, the user is free to lie down on the sleeping surface (10), and may extend the retractable awning (20) if desired. (180)

Alternate embodiments of the present invention may employ a modular design, which facilitates the removal of the sleeping surface from the remainder of the present invention via one or more zippers. As such, the sleeping surface may be installed to other variants of bags, such as carry-on luggage, handbags, or other similar luggage.

In primary embodiments of the present invention, the first panel (140), second panel (150), and third panel (160) are unitary, such that the inflation of one of the panels leads to the inflation of all panels. It is envisioned that a cell phone pocket is present at a first top corner of the first panel (140). A secondary concealed pocket is preferably present at a second top corner of the first panel (140).

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. A sleeping backpack apparatus comprising:

a bag;

wherein said bag is equipped with compartments;

a trolley handle, said trolley handle configured to extend from a top of said bag;

a sleeping surface, said sleeping surface configured to extend from a sleeping surface storage compartment;

wherein said sleeping surface is inflatable;

extension supports, said extension supports disposed at a bottom of said bag;

wherein said extension supports extend parallel to said sleeping surface;

an awning, said awning configured to extend from said top of said bag;

wheels;

wherein said wheels are disposed on said bottom of said bag;

an air pump, said air pump disposed in communication with said sleeping surface;

a power source, said power source in communication with said air pump;

at least one LED light, said at least one LED light in communication with said awning; and wherein said at least one LED light is powered via said power source.

2. The apparatus of claim 1, further comprising:

a power switch, said power switch in communication with said power source; and wherein said power source is rechargeable.

3. The apparatus of claim 1, further comprising:

at least one USB output; and wherein said at least one USB output is in communication with said power source.

4. A sleeping backpack apparatus comprising:

a bag;

wherein said bag is equipped with compartments;

a trolley handle, said trolley handle configured to extend from a top of said bag;

a sleeping surface, said sleeping surface configured to extend from a sleeping surface storage compartment;

wherein said sleeping surface is inflatable;

extension supports, said extension supports disposed at a bottom of said bag;

wherein said extension supports extend parallel to said sleeping surface;

an awning, said awning configured to extend from said top of said bag;

wheels;

wherein said wheels are disposed on said bottom of said bag;

at least one strap, said at least one strap disposed on a rear of said bag;

dual extension supports, said dual extension supports configured to extend from said rear of said bag;

wherein said dual extension supports, when extended, maintain said bag in an upright position; and wherein said sleeping surface storage compartment is disposed on a front of said bag.

5. A sleeping backpack apparatus comprising:

a bag;

wherein said bag is equipped with compartments;

a trolley handle, said trolley handle configured to extend from a top of said bag;

a sleeping surface, said sleeping surface configured to extend from a sleeping surface storage compartment wherein said sleeping surface is inflatable;

extension supports, said extension supports disposed at a bottom of said bag;

wherein said extension supports extend parallel to said sleeping surface;

an awning, said awning configured to extend from said top of said bag;

wheels;

wherein said wheels are disposed on said bottom of said bag;

at least one strap, said at least one strap disposed on a rear of said bag;

dual extension supports, said dual extension supports configured to extend from said rear of said bag;

wherein said dual extension supports, when extended, maintain said bag in an upright position; and wherein said sleeping surface storage compartment is disposed on a front of said bag.

* * * * *